United States Patent [19]

Bublewicz

[11] Patent Number: 5,003,800

[45] Date of Patent: Apr. 2, 1991

[54] DOOR LOCK CONTROL SYSTEM FEATURING A REMOTE CONTROL FOR A PNEUMATICALLY POWERED DOOR LOCK MECHANISM

[75] Inventor: Leszek Bublewicz, San Antonio, Tex.

[73] Assignee: Phelps-Tointon, Inc., Greeley, Colo.

[21] Appl. No.: 380,865

[22] Filed: Jul. 17, 1989

[51] Int. Cl.[5] ..... E05B 53/00

[52] U.S. Cl. ..... 70/264; 70/143

[58] Field of Search ..... 70/256, 257, 262–264, 70/432, DIG. 48, 143

[56] References Cited

U.S. PATENT DOCUMENTS

| | | | |
|---|---|---|---|
| 2,185,175 | 1/1940 | Adam | 70/143 X |
| 3,016,968 | 1/1962 | Lenz et al. | 70/256 X |
| 3,785,187 | 1/1974 | Wolz | 70/264 |
| 3,830,332 | 8/1974 | Fontaine | 70/257 X |
| 3,872,697 | 3/1975 | Wellekens | 70/143 X |
| 3,912,309 | 10/1975 | Fischer et al. | 70/143 X |
| 3,933,380 | 1/1976 | Wellekens | 70/143 X |
| 4,005,885 | 2/1977 | Austin, Jr. | 70/264 X |
| 4,652,862 | 3/1987 | Verslycken | 70/263 X |
| 4,685,316 | 8/1987 | Hicks et al. | 70/256 |
| 4,788,839 | 12/1988 | Shuler | 70/143 |
| 4,835,533 | 5/1989 | Akutsu | 70/256 X |
| 4,887,442 | 12/1989 | Lavelle | 70/143 |

FOREIGN PATENT DOCUMENTS

| | | | |
|---|---|---|---|
| 284654 | 10/1988 | European Pat. Off. | 70/264 |
| 2923505 | 12/1980 | Fed. Rep. of Germany | 70/264 |
| 3502752 | 7/1986 | Fed. Rep. of Germany | 70/264 |
| 8302592 | 8/1983 | World Int. Prop. O. | 70/252 |

*Primary Examiner*—Gary L. Smith
*Assistant Examiner*—Suzanne L. Dino
*Attorney, Agent, or Firm*—Gunn, Lee & Miller

[57] ABSTRACT

A remote control station and integrally installed electronic control circuit for use with a bolt and lock mechanism is set forth. In the lock, an air supply connected with first and second solenoid valves is incorporated and has a rod which extends to manipulate the bolt; bolt position is indicated by a switch means determining movement of the bolt to the deadlock position, and a door position switch is also incorporated. Various control signals are formed and are interlocked so that remote control or key switch control of the lock mechanism is obtained. It is implemented by providing control signals to the solenoid valves. They cause the bolt to move between the deadbolt and retracted positions, or to the intermediate slamlock position.

6 Claims, 2 Drawing Sheets

DOOR LOCK CONTROL SYSTEM FEATURING A REMOTE CONTROL FOR A PNEUMATICALLY POWERED DOOR LOCK MECHANISM

BACKGROUND OF THE DISCLOSURE

This disclosure is directed to a door lock system and in particular one which is able to positively control a door lock with interaction between key switching, remote control and a sensor determining door position. This is particularly intended for use with doors cooperative with a door frame in remotely controlled door lock systems of the sort installed in jails, bonded warehouses and other facilities. One typical facility involves a remotely located person who may view one or many dcors as would occur in a bonded warehouse having multiple tenants where each tenant has an isolated area for storage of their goods, and another common application is in jails or prisons.

The present apparatus is particularly concerned with control of a door lock which is installed optionally in a door frame but preferably in a door. That is, the door frame is metal door frame installed in a wall and which supports lock control system of the present disclosure. Thus, the door supports a lock which has a bolt which moves between any three positions. One position is fully retracted, and another position is the deadlock position. The deadlock position involves extension of the bolt and holding it in the extended state so that it cannot be retracted. The intermediate position involves the slamlock position where the bolt is extended, but it is not locked so that it can slide out of the way and then re-extend. This is the position achieved prior to closing the door, as the door is closed, the striker plate engages the bolt to gently slide it back into the lock and will thereafter permit the bolt to re-extend through the striker plate. Typically, the bolt will then be switched to the deadlock position. In any event, all the foregoing is accomplished in a sequence subject to several modes of control discussed below.

One control mechanism is operation by a key which is inserted into the lock mechanism. To that end, the present system incorporates such a key. In addition, however, there is a remotely located control station which can be a few feet or many feet away. It is typically located for remote control by a person who normally has visual observation of the locked door. In any event, it is remotely connected to provide a remote indication of the status of the lock and subjects the lock to remote control. There is an interlock which is known as the door position switch (DPS) which senses whether or not the door is actually fully closed. It is possible for the door to appear at a distance to be fully closed when it is slightly ajar. In this system, the DPS determines that the door has been fully closed so that the bolt, whether extended or not, is aligned so that it can extend through the striker plate and accomplish latching. This system is particularly useful in a lock system involving pneumatically powered lock mechanisms. In that instance, the system includes a deadlock position switch within the lock which provides a signal that deadlocking has been accomplished. Moreover, it also incorporates solenoid valve controllers which provide air to a double acting piston and cylinder arrangement so that the piston positively controls the bolt, that is extending and retracting the bolt between the deadlock position, the slamlock position and the retracted position.

The control system of the present disclosure involves a very small electronic component which can be easily installed within the lock mechanism, occupying very little space, and which is provided with electrical power for its operation from the remote station. The remote control station includes simple switches and thus connects with a minimum number of conductors.

The present apparatus is summarized as an electronic component which is installed in a lock mechanism and which cooperates with a key switch on the lock mechanism. It also cooperates with a pneumatic actuator which is a double acting cylinder subject to control of a pair of solenoid valves to cause extension and retraction. That is connected with the door lock mechanism including the bolt. Preferably all this equipment is installed in the door frame although it can be installed in the door if essential. It is preferable to install in the frame so that it is fixed. It incorporates a remote control station which provides power for the electronic components. The DPS is mounted so that it can test the door for full closure.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
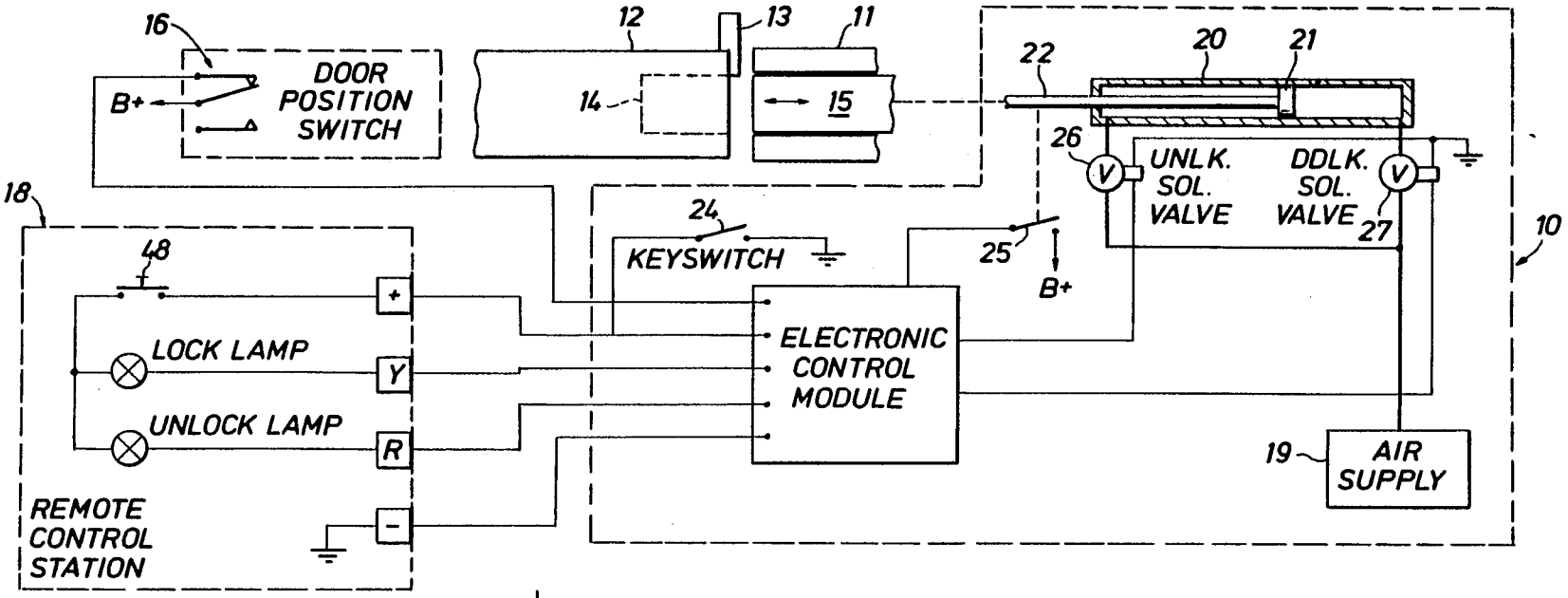
FIG. 1 shows a door and door frame subject to control by the control system of the present disclosure including a remote control station for operation of the pneumatically powered lock system.

Going first to FIG. 1 of the drawings, the lock control system of the present disclosure is identified by the numeral 10 and is that apparatus which is primarily located within the dotted line. It cooperates with a door frame 11 and an adjacent door 12. The door supports a striker plate 13 which has an opening 14 formed therein to receive a bolt 15. In this deployment of the equipment, the door is moveable relative to the frame and supports the striker plate. The bolt 15 is mounted in the door and the lock control system 10 are mounted in the door frame. An alternate arrangement can position both the bolt and lock control system in the door or door frame. It is however preferable to locate the lock control system in the door frame where movement is not required. If it is located in the door, certain electrical conductors and a pneumatic supply line must extend either through the hinge or otherwise pivot to provide air and electrical power to the movably mounted equipment within the door.

A DPS (door position switch) 16 is located relative to the door and door frame so that it senses full closure of the door. It is normally mounted on the frame recessed in a location for engagement by full closure of the door. It is located so that partial closure will not be sufficient to operate this switch. In other words, operation occurs only when the door is brought to a full closed position.

A suitable pneumatically powered construction is set forth in application Ser. No. 07/308,241 which was filed on Feb. 8, 1989 and which is incorporated herewith in its entirety. FIG. 1 shows additionally a remote control station 18 which is installed between a few feet and several hundred feet away. It is connected by suitable wiring which connects with the electronic components shown within the dotted line at 10. Additionally, the numeral 19 identifies an air supply which provides air to a pneumatic cylinder 20. It encloses a piston 21 which extends a piston rod 22. The rod 22 operates in conjunction with the bolt 15 to provide deadlocking. In one operative mode, the cylinder accomplishes deadlocking of the bolt; in another position, the bolt is unlocked by operation of the cylinder 20. This moves the bolt to the slamlock position or to the retracted position. Three positions are achieved by the cylinder. If desired, two single acting cylinders can be used to accomplish the three positions. The cylinder is provided with pneumatic power delivered to both ends of the cylinder by appropriate solenoid control valves to be described.

The lock system incorporates a key switch 24. This switch is operated by a key which is inserted into the lock by personnel who are provided with such a key. On operation, the key switch is closed and provides a signal of key switch operation. The significance of this will be understood more readily hereinafter. In addition to that, the bolt position, namely whether it is deadlocked or unlocked, is indicated from the bolt 15 or preferably by the piston rod 22. This is accomplished at a switch 25. This is the deadlock position switch or LBS hereinafter. The LBS 25 is mounted at an appropriate location to sense the accomplished movement of the equipment within the lock assembly whereby deadlocking is accomplished. Only when deadlocking has been accomplished is a signal provided through the LBS 25. This forms the appropriate signal as described above.

The present system includes a first solenoid valve 26 and a second solenoid valve 27. They are connected to deliver air under pressure to opposite ends of the cylinder 20. They are in turn operated by solenoids which are shown at remote locations. It will be understood that the two solenoids are constructed integral with the valve assemblies. They serve as electrically powered operators for the respective valves. The valves must be provided with electrical power for operation. The two valves are switched as required to drive the piston 21 to any of three positions in the cylinder. In the preferred embodiment, the valves 26 and 27 are three-way valves. That is, each is provided with air from the air supply and another opening is a vent. This evacuates the cylinder so that the piston can travel to both ends of its stroke.

Figure 2:
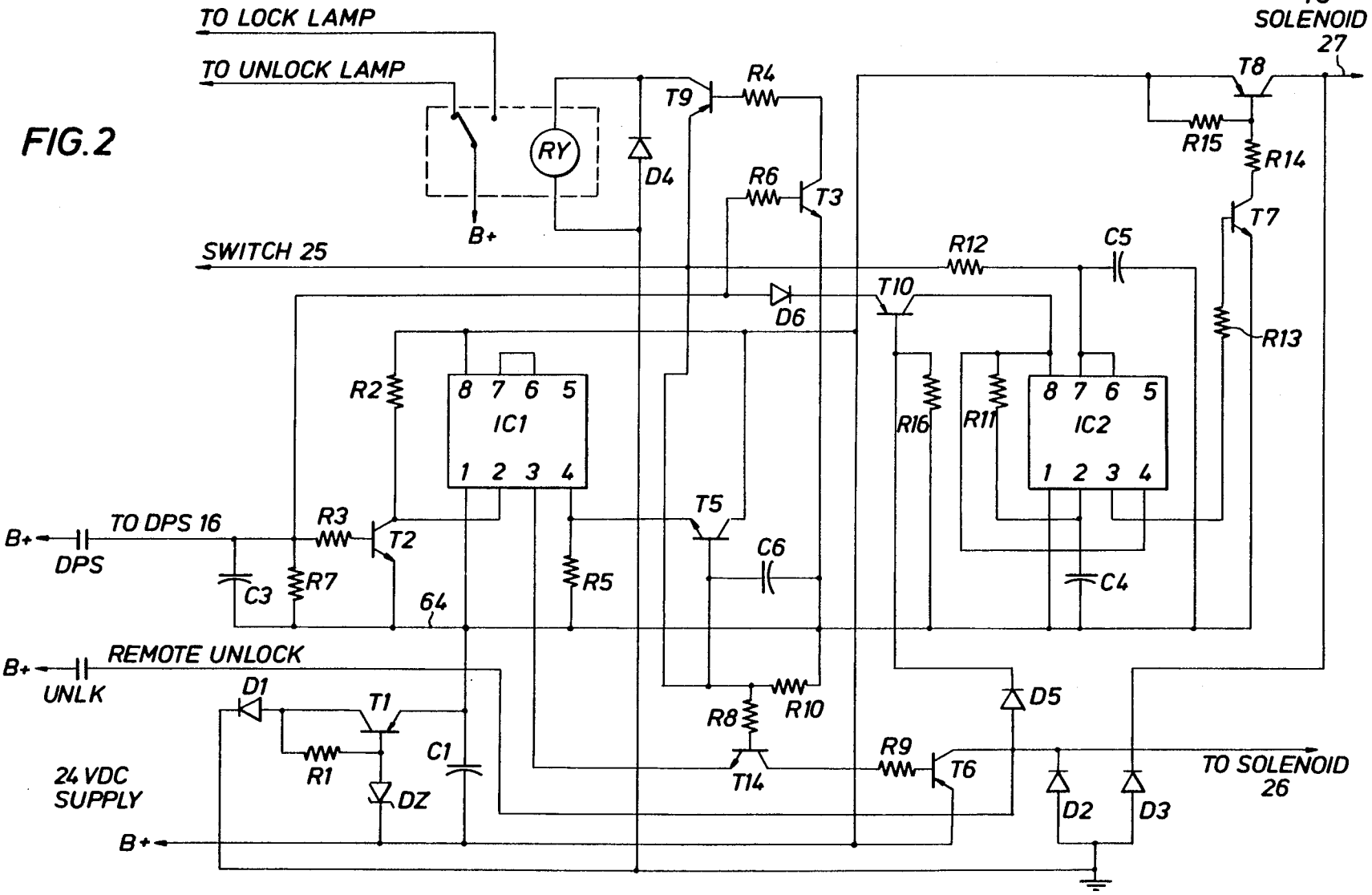
FIG. 2 is a schematic wiring diagram of the control apparatus shown in FIG. 1.

Attention is now directed to FIG. 2 of the drawings which shows in greater detail the circuitry which was indicated in the block diagram schematic in FIG. 1. In addition, certain connections are also included. FIG. 2 is perhaps best understood in conjunction with the various inputs and outputs shown in the timing chart of FIG. 3. In any event, a description of the circuitry shown in FIG. 2 will be given first, and its operation will be understood in greater detail hereinafter. Going now to FIG. 2 of the drawings, a circuit is shown which utilizes two timer circuits IC1 and IC2 which are preferably identical in construction. A timing function is obtained by imposing the selected RC timing circuit thereon. The circuit IC1 operates as a latch because it lacks a RC timing circuit. Both of the timing circuits IC1 and IC2 are provided with a reset signal at the pin 4 and form output signals at the pin 3. A set signal is input to each at pin 2. The power input terminal is pin 8. The RC input terminal is at terminal 6 or 7, and it will be observed that no connection is made for IC1 at those pins. The circuit additionally includes the various resistors, capacitors and diodes shown as illustrated. Additionally, there are the transistors T1 through T9. The transistors T2 and T9 are used as switching elements, not amplifiers, and accordingly, they are driven completely to saturation.

Operation of the present apparatus should now be considered. If the door 12 of FIG. 1 is open, the initial conditions that prevail are the DPS 16 is open and B+ is not input to the transistor T2, the LBS (lock bolt switch) 25 is open indicating that the lock bolt 15 is in the slamlock position, the relay RY is de-energized which forms an unlock lamp signal at the remote control station, and there is no power to the solenoid valves, and hence both valves 26 and 27 have no power for operation.

One protective feature of the present system is protection of the bolt 15. The bolt 15 is constructed to withstand slamming as it moves from the slamlock position to the deadbolt position. Bolt movement occurs when the door or gate is slammed vigorously. However, it is possible that damage may occur if the bolt is extended and is in the deadlock position. Sabotage is prevented, i.e. a person cannot move the bolt to the deadlock position while the door is open. If one were to do this, the following interlock would occur, thereby preventing damage while slamming the door with the bolt extended in the deadlock position. The open gate is sensed by the DPS 16 which forms an open signal and thus, the timer IC1 is not triggered and the output signal at the pin 3 is therefore low. The LBS 25 is sensitive to operation of the bolt to the deadlock position. The pin 3 of IC1 connects to T4 and a signal is formed which switches the transistor T4 to a conducting state, in turn providing conduction to the transistor T6 and in turn providing current to the solenoid 26. The solenoid 26 is connected to the pneumatic system for operation to cause pneumatically controlled unlocking of the deadbolt. That is, the bolt is converted from the deadlock position into the unlock position. This in effect changes the operative condition of the bolt 15 from the deadlock position to the slamlock position. Once this is accomplished, the circuitry returns to its neutral state. The foregoing sequence is shown in the timing chart by the signal 30 which is input from the LBS 25 and which causes formation of the pulse 32 which is directed to the solenoid 26. The pulse is relatively short and need only be sustained for a short fraction of a second to assure that pneumatic operation is completed whereby the solenoid 26 is operated to provide the waveform 32 which is the unlock signal.

DOOR CLOSURE AND RESULTANT SIGNALS

Assume that the door 12 is properly closed. If so, the following signals occur. B+ is input from the DPS 16 and switches on the transistor T2 which provides the set signal for the time IC1. In addition, this input signal to the base of T2 is likewise supplied through the diode D6 and the switching transistor T10. This operates the circuit IC2 which forms an output at pin 3 to switch on the transistor T7, switching on the transistor T8 and supplying current to the solenoid 27. This brings the bolt 15 to the deadlock position. In addition, this movement operates the switch 25 to indicate operation of the bolt. This inputs the signal back through the resistor R12 in cooperation with the capacitor C5, timing in accomplished so that the timer IC2 clocks out or completes its timing cycle and switches off, removing power from the solenoid 27. This normally lasts one second in operation.

Figure 3:
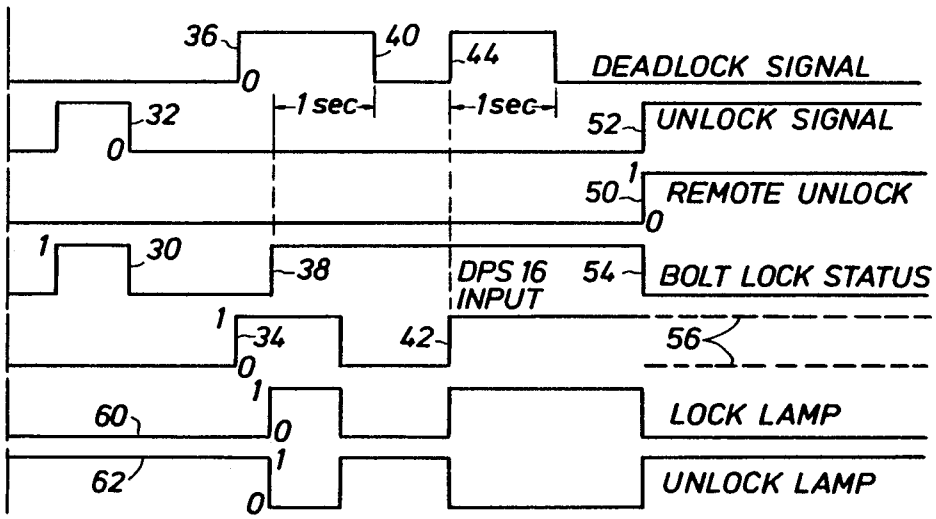
FIG. 3 is a timing chart showing the timed relationship of several signals.

In FIG. 3 of the drawings this sequence is shown and is initiated by the leading edge of the pulse at 34. When that occurs, the signal for the solenoid 27 becomes positive as shown at the leading edge of the signal. That signal runs for the duration determined by the timing of the RC circuit just mentioned; that signal is terminated by the trailing edge of the pulse 34 which coincides with the trailing edge of the pulse 36. Of course, feedback or verification is accomplished by the leading edge of the pulse 38; that signal continues so long as the bolt is in the locked status; however, the one second interval is accomplished between the leading edge of the pulse 38 and the trailing edge 40 of the pulse 36 where the pulse 36 goes negative. Another sequence of operation is also shown utilizing the timing chart of FIG. 3. The timing chart of FIG. 3 shows a change in the position of the door which is transmitted by the DPS 16. This is the positive going signal 42. When this signal is present, it provides the enable pulse to the timer IC1 which forms the positive going pulse 44. This signal causes operation of the solenoid valve 27, and additionally holds that sufficiently long that it has time to complete deadbolt locking. The signal does not need to persist and to that end, it has a short duration, approximately one second which is determined by the RC time constant of the selected components connected to the timer IC2.

An additional sequence of operation is illustrated in the timing chart where the remote control unit is operated by depressing a switch 48. It is depressed momentarily to provide B+ to the remote unlock input, and that is delivered to the anode of the diode D5. That is coupled directly to the output of the solenoid 26 for unlocking. The input signal identified at 50 and the solenoid output signal occur at the same instant at 52. This achieves pneumatic alteration of the bolt from the deadlock position, and that is sensed by the switch 25 which provides verification as represented in the timing chart by the state change at 54. This permits the door to be opened; it can be opened or left closed, but its state is determined by the DPS 16 which provides the output signal at 56 which is indicative of opening or closing.

In the foregoing operations, the timing chart shows the two patterns at 60 and 62 which are associated with lamps at the remote station. One can be omitted and the other can be relied upon for an indication. However, it is preferable to use two lamps so that one positively indicates the state of affairs continuously. To this end, when one lamp is on, the other lamp is off as identified in the timing patterns at 60 and 62.

Several of the components shown in FIG. 2 have functions which have not been specifically delineated. The transistor T1 along with the associated circuitry serves as a voltage regulator which regulates the voltage level on the line 64. That line is input to several of the components to provide a proper or selected operating voltage for the components. The transistor T2 primarily responds with a switching function dependent on an input signal through the DPS 16; thus, when it operates, it provides an input signal to the second pin of the timing circuit IC1. That in turn forms a signal at the output on pin 4 which is coupled through the transistor T5. In addition, an input B+ from the DPS 16 is also provided to the base of the transistor T4, providing a switch function, and that in turn switches on the transistor T9 and that in turn causes conduction through the relay RY. When the transistor T9 conducts, relay operation is provided.

The diodes D2 and D3 provide a clipping function to avoid negative overshoot on switching for the solenoid drive currents. Solenoids are primarily inductive; when provided with a step function input, they may ring and these two diodes provide clipping to prevent ringing.

The device of the present invention is a control circuit which enables control of the locked door either subject to the key switch 24 or the remote switch 48. It is particularly useful in providing a positive interlock in the DPS 16 control operation only when the door is properly aligned with the door frame 11. Moreover, the lock includes the deadlock switch 25 which provides assurance that the deadlocking position has been achieved, thereby yielding a feedback signal which enables completion of operation. It is a system which can operate either with a single double acting pneumatic cylinder or with two separate single acting pneumatic cylinders. Recall as mentioned earlier that the bolt has three positions which are fully retracted, fully extended in the deadlock position, or extended in the slamlock position. In the intermediate position, the bolt is free to slide so that it can slide over the striker plate 13.

While the foregoing is directed to the preferred embodiment, the scope is determined by the claims which follow:

What is claimed is:

1. A control system for remotely controlling a bolt in a door locking system from the unlock, slamlock, and deadlock positions while still allowing local operation of said bolt, the control system comprising:

(a) a door and a door frame adapted for closing or opening by rotating on a hinge supporting said door;

(b) remote control means connected to said bolt for controlling operation of said bolt at a remote location relative to said door locking system, said bolt being controlled between said unlock, slamlock, and deadlock positions;

(c) local control means connected to said bolt for controlling operation of said bolt at a local location relative to said door and door frame, said bolt being movable in said door locking system;

(d) door position switch means connected to said door for determining movement of said door with respect to said door frame, said door position switch means generating a door closed signal when said door is closed and feeding said door closed signal to said remote control means;

(e) bolt position means adjacent to said bolt for determining movement of said bolt into said deadlock position and generating a bolt position signal responsive thereto;

(f) powered means connected to said bolt and operated by said remote control means for retracting and extending said bolt, said powered means having (i) said deadlock position of said bolt,
(ii) said slamlock position of said bolt, and
(iii) said unlock position of said bolt; and (g) said powered means further comprising
(i) a double acting pneumatically powered piston rod in a cylinder,
(ii) a first solenoid valve delivering air to a first side of said piston rod, and
(iii) a second solenoid valve delivering air to a second side of said piston rod.

2. The control system of claim 1 wherein said first solenoid valve and said second solenoid valve are three-way valves allowing said air to vent from said cylinder.

3. The control system of claim 1 wherein said first solenoid control valve and said second solenoid control valve are controlled by an electronic control module.

4. A control system for remotely controlling a bolt in a door locking system from the unlock, slamlock, and deadlock positions while still allowing local operation of said bolt, the control system comprising:

(h) a door and a door frame adapted for closing or opening by rotating on a hinge supporting said door;

(i) remote control means connected to said bolt for controlling operation of said bolt at a remote location relative to said door locking system, said bolt being controlled between said unlock, slamlock, and deadlock positions;

(j) local control means connected to said bolt for controlling operation of said bolt at a local location relative to said door and door frame, said bolt being movable in said door locking system;

(k) door position switch means connected to said door for determining movement of said door with respect to said door frame, said door position switch means generating a door closed signal when said door is closed and feeding said door closed signal to said remote control means;

(l) bolt position means adjacent to said bolt for determining movement of said bolt into said deadlock position and generating a bolt position signal responsive thereto;

(m) powered means connected to said bolt and operated by said remote control means for retracting and extending said bolt, said powered means having
(i) said deadlock position of said bolt,
(ii) said slamlock position of said bolt, and
(iii) said unlock position of said bolt; and (n) said powered means is at least two single acting pneumatically powered piston rods.

5. The control system of claim 1 or claim 4 wherein said local control means is a key operated cylinder.

6. The control system of claim 1 or claim 4 including sabotage prevention means wherein said door position switch means being connected with said bolt through said powered means to prevent said deadlock position of said bolt if said door position switch generates an open signal.

* * * * *